US006328489B1

(12) United States Patent
Chi-Pin

(10) Patent No.: US 6,328,489 B1
(45) Date of Patent: Dec. 11, 2001

(54) KEY MECHANISM IN A COMPUTER KEYBOARD

(75) Inventor: Yeh Chi-Pin, Tainan Hsien (TW)

(73) Assignee: Acer Peripherals, Inc. (TW)

( * ) Notice: Subject to any disclaimer, the term of this patent is extended or adjusted under 35 U.S.C. 154(b) by 0 days.

(21) Appl. No.: 09/558,218

(22) Filed: Apr. 26, 2000

(30) Foreign Application Priority Data

Apr. 29, 1999 (TW) ..... 88106976

(51) Int. Cl.[7] ..... B41J 5/14; B41J 5/16

(52) U.S. Cl. ..... 400/496; 400/490; 400/491.2; 200/344; 200/345

(58) Field of Search ..... 400/496, 490, 400/495, 491.2; 200/344, 345

(56) References Cited

U.S. PATENT DOCUMENTS 5,399,822 * 3/1995 Sato et al. ..... 200/344
5,947,616 * 9/1999 Liang ..... 400/491.2
6,040,541 * 3/2000 Li ..... 200/344
6,056,459 * 5/2000 Tsai ..... 400/496

* cited by examiner

*Primary Examiner*—Daniel J. Colilla

(57) ABSTRACT

A key mechanism includes a keycap, a base plate installed under the keycap having three guide channels, a connecting device installed between the keycap and the base plate for movably connecting the keycap to the base plate in an up and down manner, and a resilient element installed under the keycap for elastically supporting the keycap upwardly. The connecting device includes a first connecting piece and a second connecting piece, each having a front end, a center portion, and a rear end. Each of the center portions of the first and second connecting pieces has a left end and a right end, and the left and right ends of the center portions of the connecting pieces are pivotally connected to each other. The left and right ends and the center portion of the front end of the first connecting piece are slidably and separately received in the three guide channels, while the rear end of the first connecting piece is pivotally mounted beneath the keycap. The front end and the rear end of the second connecting piece are pivotally or slidably mounted to the keycap or the base plate, respectively.

14 Claims, 15 Drawing Sheets

KEY MECHANISM IN A COMPUTER KEYBOARD

BACKGROUND OF THE INVENTION

1. Field of the Invention

The present invention relates to a key mechanism, and more particularly, to a key mechanism in a computer keyboard.

2. Description of the Prior Art

Please refer to FIG. 1 an FIG 2. FIG. 1 is a schematic diagram of the key mechanism 11 of the prior art. FIG. 2 is a perspective view of the connecting device 17 of the key mechanism 11 shown in FIG. 1. The key mechanism 11 comprises a keycap 12, a base plate 14 set up below the keycap 12, a connecting device 17 connected between the keycap 12 and the base plate 14 for up-and-down movably installing the keycap 12 on the base plate 14, and a resilient element 19 installed under the keycap 12 for elastically supporting the keycap 12 in the upward direction and pressing downward on a pressure sensor (not shown) to generate a key-pressing signal. The connecting device 17 further comprises a first connecting piece 23 and a second connecting piece 24 pivotally connected to each other at their center portions 25 and 27 of the first connecting piece 23 and second connecting piece 24 respectively.

The first connecting piece 23 further comprises a front end 21 and a rear end 22 while the second connecting piece 24 comprises a front end 26 and a rear end 28. The center portion 15 at the front end 21 of the first connecting piece 23 is slidably connected to a corresponding guide channel 29 installed on the base plate 14 while the left and right sides of the rear end 22 are pivotally connected to the keycap 12. The left and right sides of the front end 26 of the second connecting piece 24 are slidably connected to the keycap 12 while the left and right sides of the rear end 28 are pivotally connected to the base plate 14. Therefore, in the key mechanism 11, the connecting device 17 uses a "three-point connection", making contact with the base plate 14 at three points: the center portion 15 at the front end 21 of the first connecting piece 23 as the first point, and the left and right sides of the rear end 28 of the second connecting piece 24 as the second and third points.

Please refer to FIG. 3 and FIG. 4. FIG. 3 is a schematic diagram of another key mechanism 10 of the prior art and FIG. 4 is a perspective view of the connecting device 16 of the key mechanism 10 shown in FIG. 3. Similar corresponding elements and component numbers are used in FIG. 3,4 as they are in FIG. 1,2. The main difference between the key mechanisms 10 and 11 is that the connecting device 16 shown in FIG. 3, 4 utilizes a four-point connection while the connecting device 17 in FIG. 1, 2 uses a three-point connection. As shown in FIG. 4, the connecting device 16 comprises a first connecting piece 18 and a second connecting piece 9. The left and right sides of the front end 20 of the first connecting piece 18 are slidably connected to guide channels 27 installed on the base plate 14. The left and right sides of a rear end 22 of the first connecting piece 18 are slidably connected to the keycap 12. The left and right sides of a front end 26 and a rear end 28 of the second connecting piece 9 are slidably and pivotably connected to the keycap 12 and base plate 14 respectively. Therefore, the connecting device 16 utilizes a "four-point connection" to connect to the base plate 14 by using the left and right sides of the front end 20 of the first connecting piece 18 as the first and second points and the left and right sides of the rear end 28 of the second connecting piece 9 as the third and fourth points.

Because of the continuing trend towards lighter and thinner keyboards, the internal components must also be made lighter and thinner. In order to meet these design requirements, the torsional strength of the first connecting pieces 23 and 18 is now relatively lower. These pieces are very susceptible to warping as they are the weakest elements in the entire key mechanism, especially when they are placed under an external force which is not in the center of keycap 12. This is especially true for long keys, such as the space bar.

There are two loading cases to be considered in the written description of the present invention. Loading case I is a balanced external force applied to the center of an element, or no force applied to the element. Loading case II is an unbalanced force applied to an element at an off-center point of the element.

Please refer to FIG. 5 and FIG. 6. FIG. 5 is the schematic diagram of warping under loading case II of the front end 21 of the first connecting piece 23 in the connecting device 17 shown in FIG. 1 and FIG. 2. FIG. 6 is a schematic diagram of warping under loading case II of the front end of the first connecting piece 18 in the connecting device 16 shown in FIG. 3 and FIG. 4.

As shown in FIG. 5, the central portion 15 will be deformed and bent downward, as indicated by the dotted lines, due to the constraints of the guide channel 29 and the base plate 14. As shown in FIG. 6, when the connecting device 16 is under loading case II, the central portion of the front end 20 of the connecting piece 18 will be deformed and bent upward, as shown by the dotted lines, due to the constraints of the guide channels 27 and lack of constraint at the central portion 39.

The warping of the first connecting pieces 23 and 18 will result in an unbalanced force being applied to the resilient element 19, and this unbalanced force will result in unstable key-press signals. Unstable key-press signals produce bad input, especially when a key is being held down.

SUMMARY OF THE INVENTION

Therefore, the main object of the present invention is to provide a key mechanism used in computer keyboards to resolve the above-mentioned problems.

In a preferred embodiment, the present invention provides a key mechanism used in a computer keyboard. The key mechanism comprises a keycap, a base plate, a connecting device and a resilient element. The connecting device moveably connects the keycap to the base plate, and the resilient element provides elastic, upward support for the key cap. The base plate has three guide channels that engage with the connecting device. The connecting device comprises a first connecting piece and a second connecting piece. Central portions of left and right ends of the connecting pieces are pivotally connected together in a scissors-like manner. Left, right and central points on a front end of the first connecting piece are slidably and separately received in the three guide channels of the base plate. A rear end of the first connecting piece is pivotally mounted to the underside of the keycap. The front and rear ends of the second connecting piece may be slidably or pivotally mounted to the keycap or base plate, respectively.

It is an advantage of the present invention that this design prevents warping of the first connecting piece when the keycap is depressed by an unbalanced external force, thereby ensuring more stable key-press signals.

This and other objectives of the present invention will no doubt become obvious to those of ordinary skill in the art after having read the following detailed description of the preferred embodiment which is illustrated in the various figures and drawings.

DETAILED DESCRIPTION OF THE PREFERRED EMBODIMENT

Figure 7:
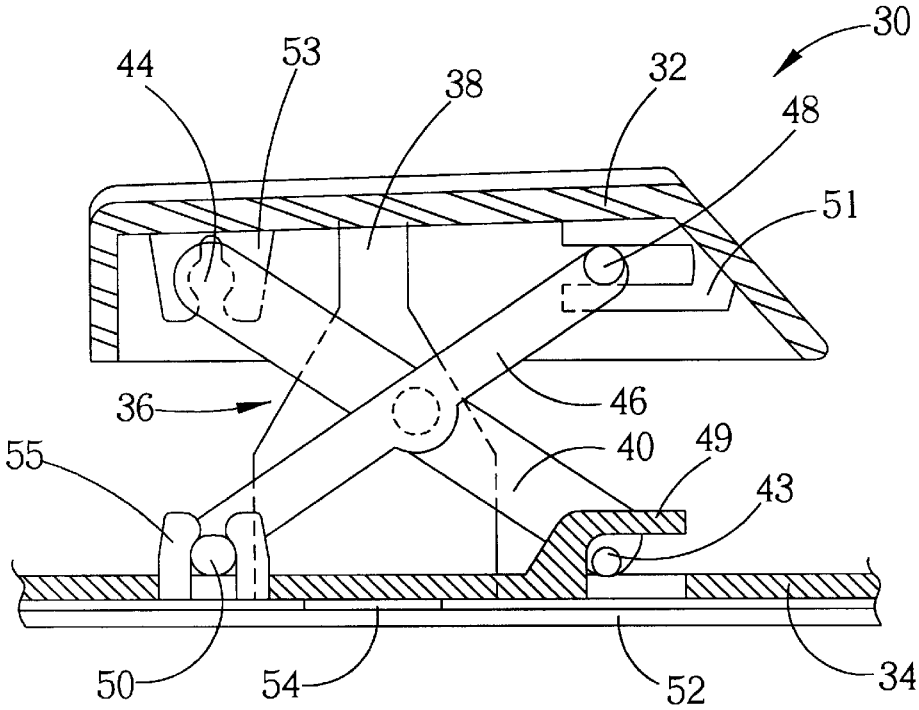
FIG. 7 is a schematic diagram of the key mechanism of the first embodiment of the present invention.
Figure 9:
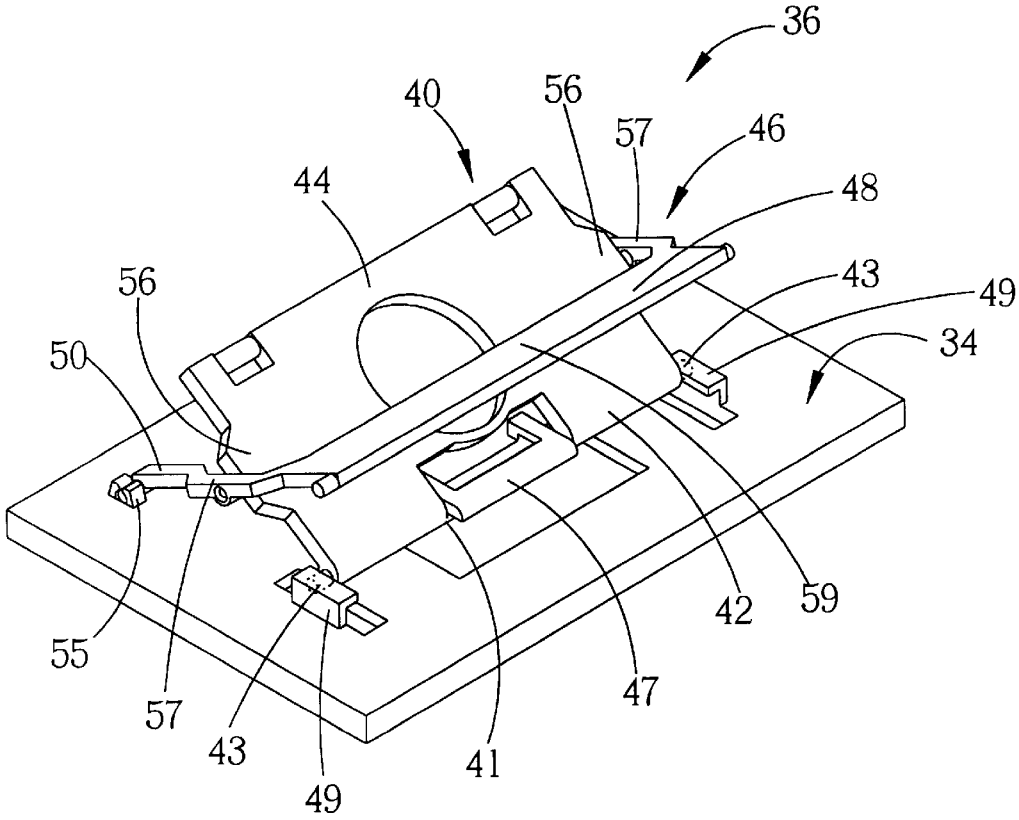
FIG. 9 is a perspective view of the connecting device of the key mechanism shown in FIG. 7.

Please refer to FIG. 7 and FIG. 9. FIG. 7 is a schematic diagram of the key mechanism 30 of the first embodiment of the present invention, and FIG. 9 is a perspective view of the connecting device 36 in FIG. 7. The key mechanism 30 comprises a keycap 32, a base plate 34, a connecting device 36 installed between the keycap 32 and the base plate 34 for up-and-down movably connecting the keycap 32 to the base plate 34, and a resilient element 38 installed under the keycap 32 for elastically supporting the keycap 32. The connecting device 36 comprises a first connecting piece 40 and a second connecting piece 46. The first connecting piece 40 comprises a front end 42, a center portion 56, and a rear end 44. The second connecting piece 46 comprises a front end 48, a center portion 57, and a rear end 50. The first connecting piece 40 and the second connecting piece 46 are pivotally connected to each other at both the left and right sides of their center portions, 56 and 57 respectively.

Figure 10:
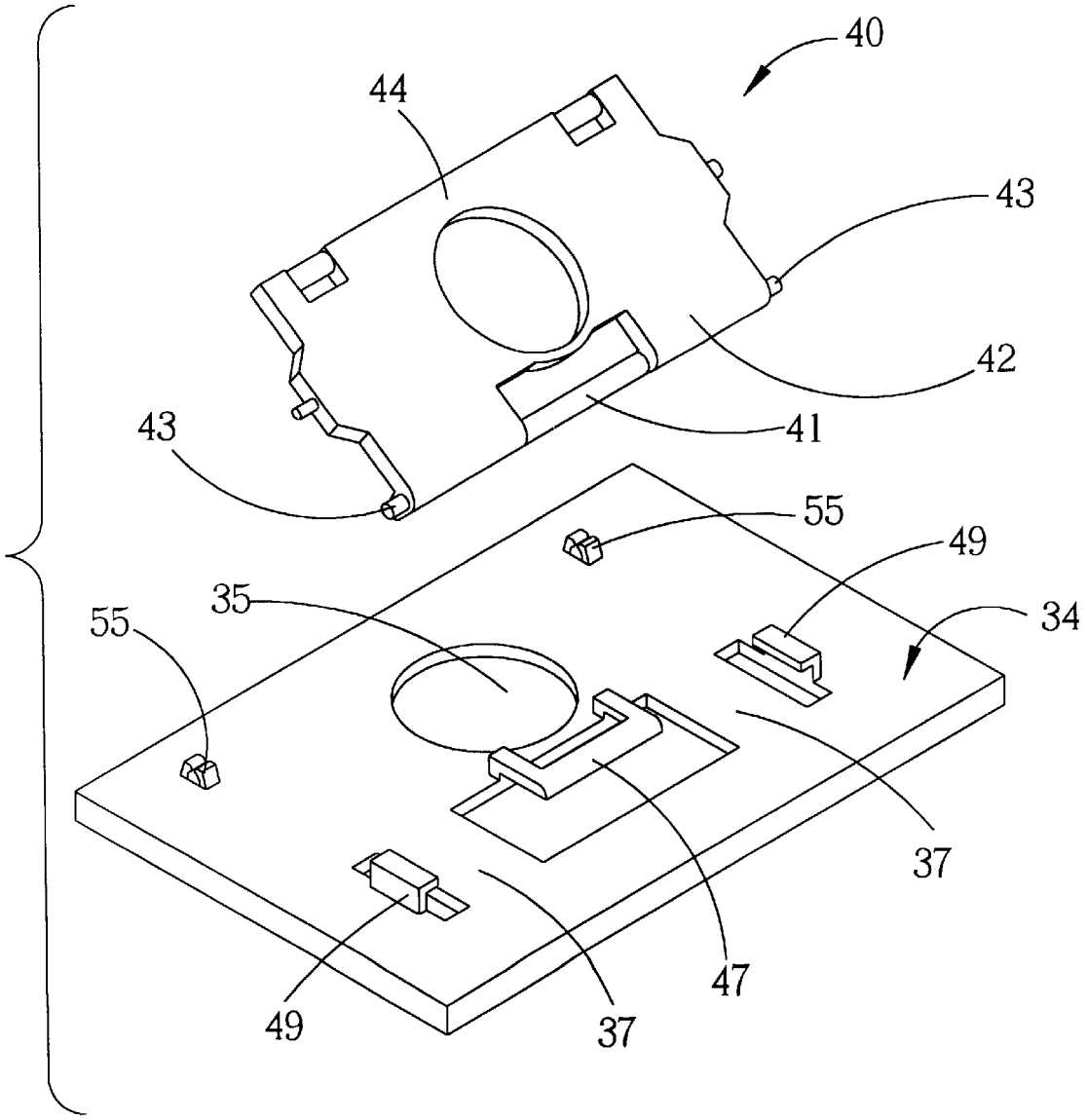
FIG. 10 is an element perspective view of the first connecting piece as well as the guide channel and the limit channel of the base plate as shown in FIG. 9.

Please refer to FIG. 7 and FIG. 10. FIG. 10 is a perspective view of the base plate 34 and the first connecting piece 40 shown in FIG. 9. The key mechanism 30 also comprises a base stand 52 (FIG. 7) installed below the base plate 34, and a pressure sensor 54 installed between the base stand 52 and the resilient element 38. As shown in FIG. 10, a penetration hole 35 is in the base plate 34 such that the bottom of the resilient element 38 can make contact with the base stand 52 by penetrating through the penetration hole 35. The top of the resilient element 38 is connected to the bottom of the keycap 32 and elastically supports the keycap 32. As the keycap 32 is pressed downward, the resilient element 38 will also press down on the pressure sensor 54 to generate a corresponding key-press signal.

Figure 11:
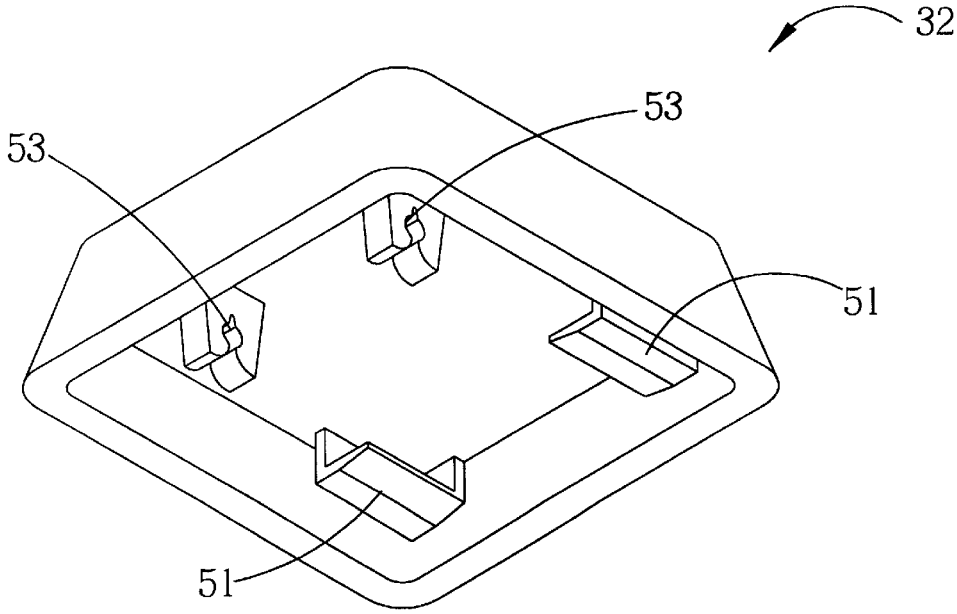
FIG. 11 is a bottom view of the keycap of the key mechanism of the first embodiment as shown in FIG. 7.

Please refer to FIG. 10 and FIG. 11. FIG. 10 is an element perspective view of the first connecting piece 40 as well as the guide channel 47 and the limit channel 49 of the base plate 34 as shown in FIG. 9. FIG. 11 is a bottom view of the keycap of the key mechanism as shown in FIG. 7. As shown in FIG. 10, the first connecting piece 40 has a guiding rod 41 at the center portion and a limiting rod 43 on the left and right side of the front end 42. A guide channel 47 is set up on the base plate 34 at the location corresponding to the guiding rod 41 while two limit channels 49 are set up on the base plate 34 at the locations corresponding to the limiting rods 43.

The front end 42 of the first connecting piece 40, which is supported by bearing areas 37, is slidably connected to the base plate 34 by its guiding rod 41 and limiting rods 43 that are contained in their corresponding matching guide channel 47 and limit channels 49, respectively, while both the left and right sides of the rear end 44 are pivotally connected to the corresponding scoop channels 53 on the bottom side of the keycap 32 shown in FIG. 11.

Please refer again to FIGS. 7, 9, 10 and 11. As shown in FIG. 9, the second connecting piece 46 is U-shaped, and the left and right sides of its front end 48 are slidably connected to the corresponding guide channels 51 on the bottom side of the keycap 32 shown in FIG. 11. The left and right sides of the rear end 50 of the second connecting piece 46 are pivotally connected to the corresponding scoop channels 55 on the base plate 34 shown in FIG. 10. Another kind of U-shaped connecting piece (not shown) can also be used for the second connecting piece 46 wherein the center portion 59 of the front end 48 is slidably connected to a corresponding guide channel (not shown) on the bottom side of the keycap 32, while the left and right sides of the rear end 50 are also pivotally connected to the corresponding scoop channels 55 on the base plate 34.

Figure 13:
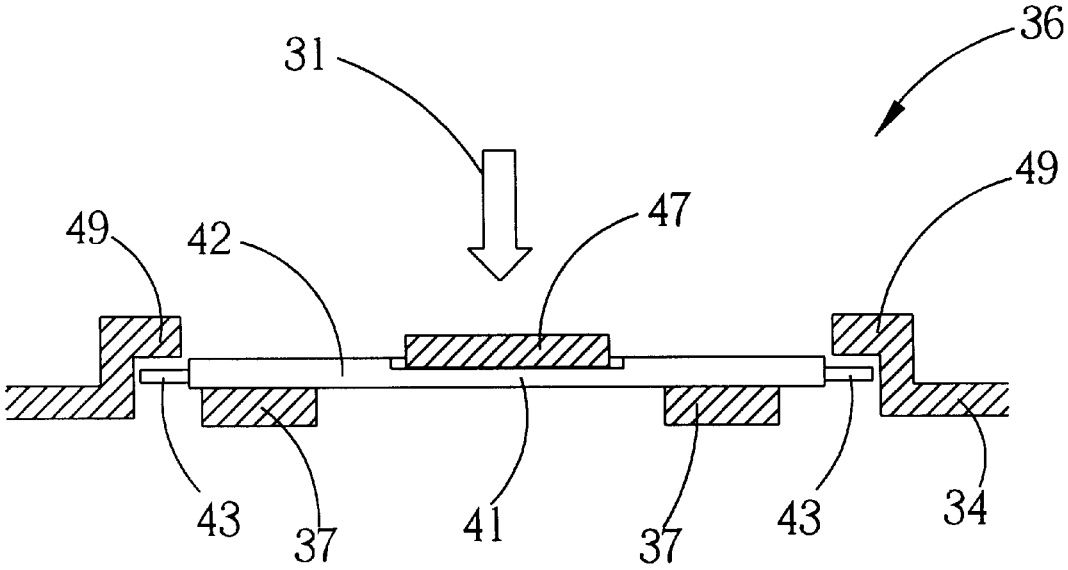
FIG. 13 is a schematic diagram of the first connecting piece of the connecting device shown in FIG. 8 under loading case I.
Figure 14:
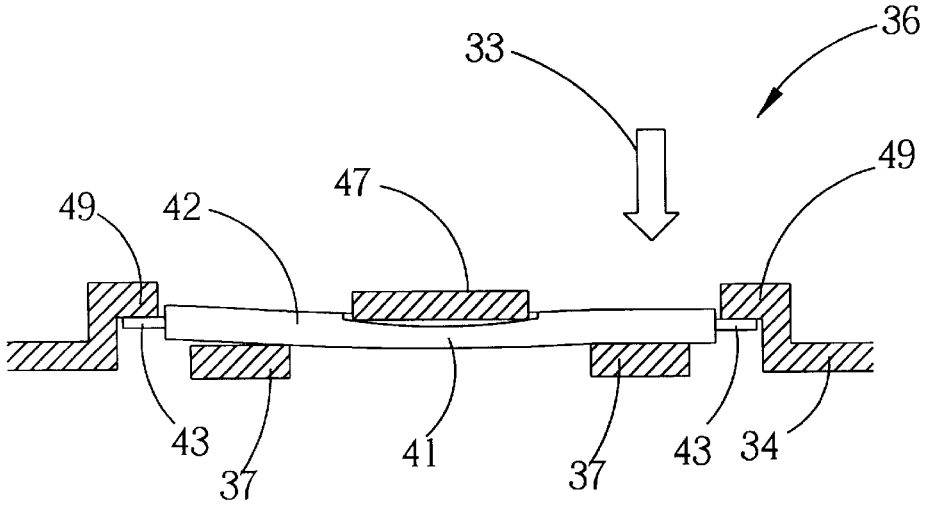
FIG. 14 is a schematic diagram of the first connecting piece of the connecting device shown in FIG. 8 under loading case II.
Figure 23:
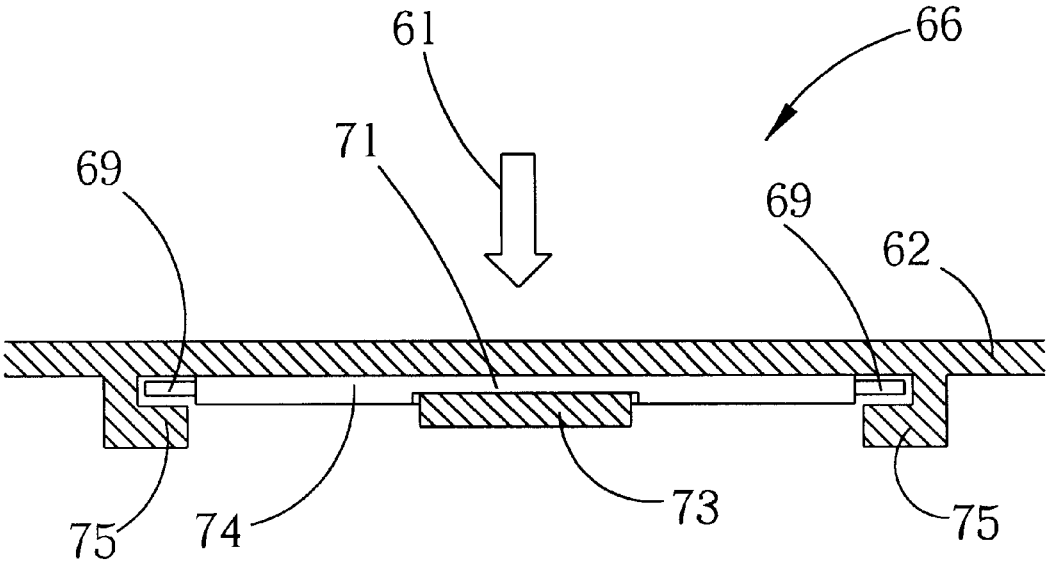
FIG. 23 is a schematic diagram of the first connecting piece of the connecting device as shown in FIG. 19 under loading case I.
Figure 24:
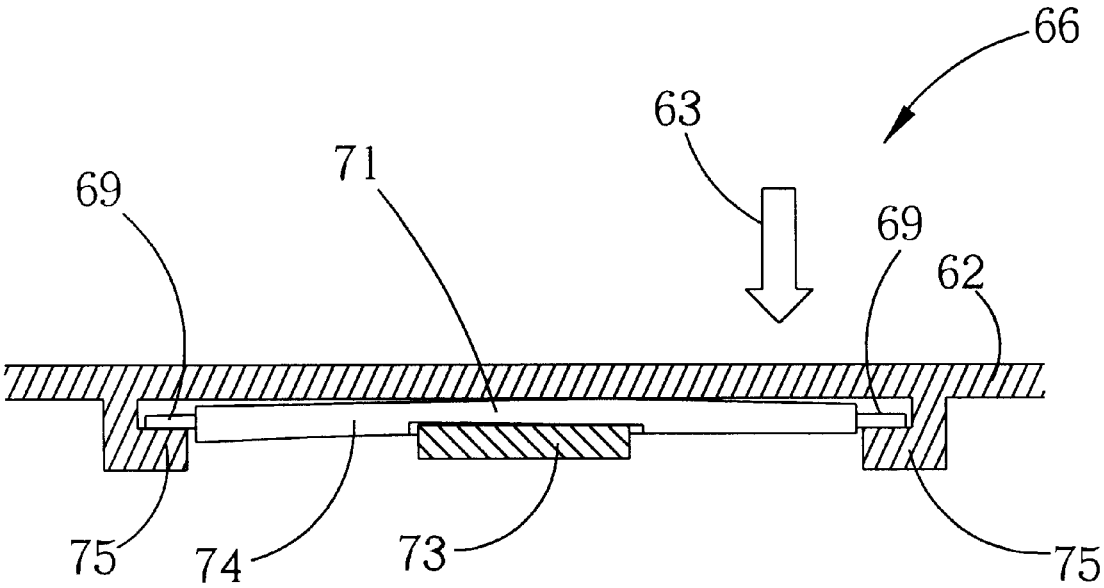
FIG. 24 is a schematic diagram of the first connecting piece of the connecting device as shown in FIG. 19 under loading case II.

Please refer to FIGS. 13,14,18,23,24 and 27. There are two loading cases to be considered in the present invention. Loading case I is a balanced external force 31,61 applied to the center of an element, or no external force applied to the element as shown in FIGS. 13, 18, 23 and 27. Loading case II is an unbalanced force 33, 63 applied to an element at an off-center point of the element as shown in FIG. 14 and 24.

Figure 12:
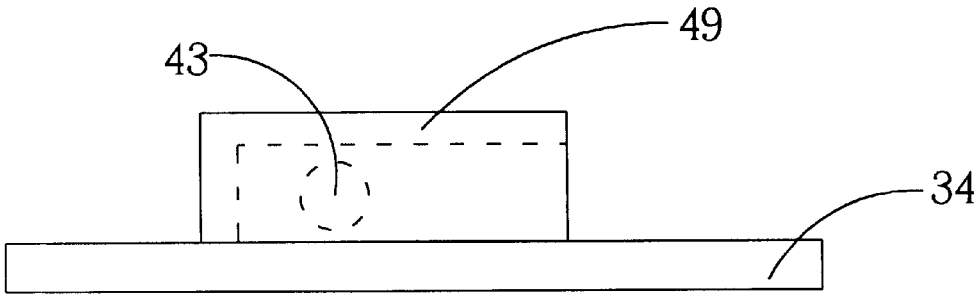
FIG. 12 is a relative position between the limiting rod and the limit channel of the first embodiment when the connecting device as shown in FIG. 9 is under loading case I.

FIG. 12 and FIG. 13 show a relative position between the limiting rods 43 and the limit channel 49 under loading case I for the first embodiment of the present invention. As shown in FIG. 13, under loading case I, the guide channel 47 will guide the guiding rod 41 of the first connecting piece 40 as it slides back and forth in the guide channel 47, and at this moment, as shown in FIG. 12 and 13, no contact occurs between the two limit channels 49 and the two limiting rods 43. Consequently, the connecting device 36 makes a three-point connection to the base plate 34. The first point is the guiding rod 41 with its guide channel 47. The two other points are the left and right sides of the rear end 50 of the second connecting piece 46 at the scoop channels 55.

Shown in FIG. 14 is a schematic diagram of the first connecting piece 40 of the connecting device 36 under loading case II. The two limit channels 49 of the base plate 34 will limit the warping of the first connecting piece 40 by preventing the limiting rods 43 from bending up. The limit channels also guide the first connecting piece 40, enabling it to continue to slide back and forth in the limit channels 49 in a nearly horizontal direction. Thus, the connecting device 36 can apply downward pressure onto the resilient element 38 without significantly tilting the resilient element 38 because of warping of the connecting device 36. In this case, the connecting device 36 makes use of a five-point connection to the base plate 34. As a result, the signal generated by the pressure sensor 54 pressed upon by the resilient element 38 will be relatively more stable.

Figure 1:
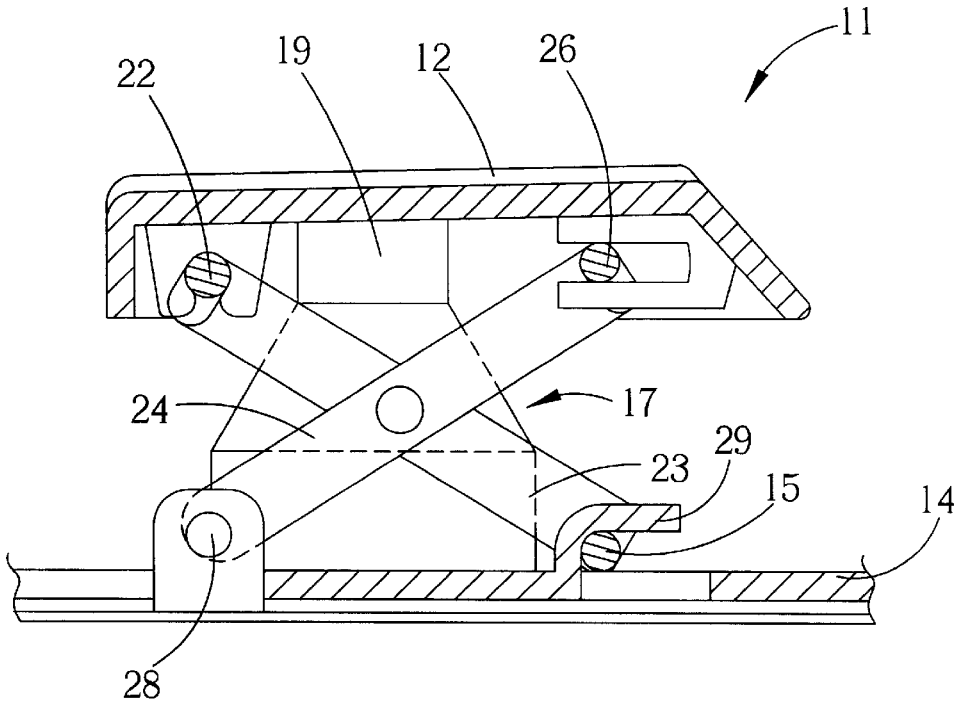
Fig. 1 Prior art
FIG. 1 is a schematic diagram of the key mechanism of the prior art.
Figure 2:
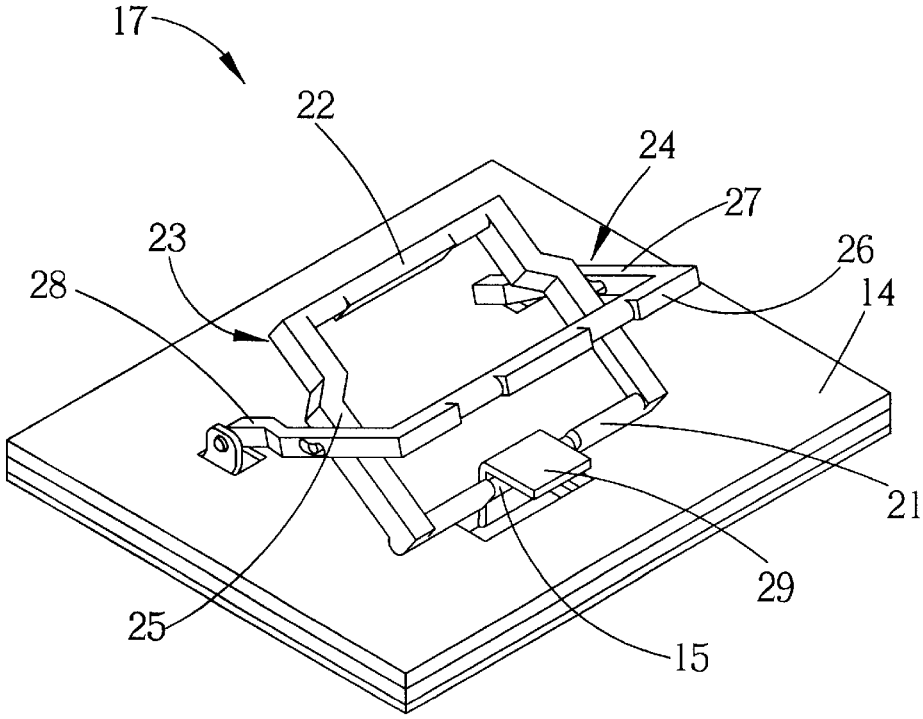
Fig. 2 Prior art
FIG. 2 is a perspective view of the connecting device of the key mechanism shown in FIG. 1.
Figure 3:
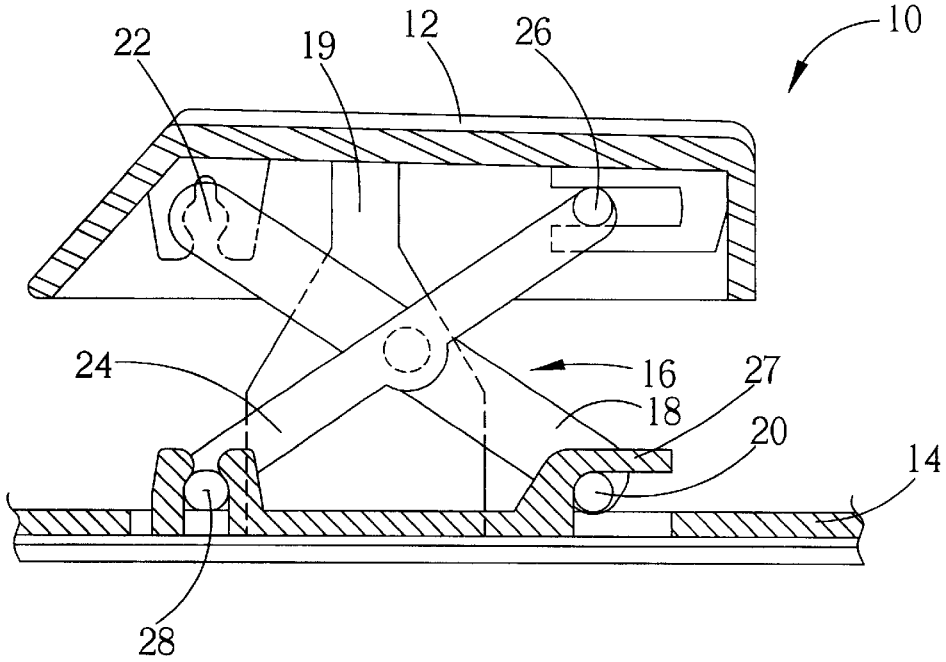
Fig. 3 Prior art
FIG. 3 is a schematic diagram of another key mechanism of the prior art.
Figure 4:
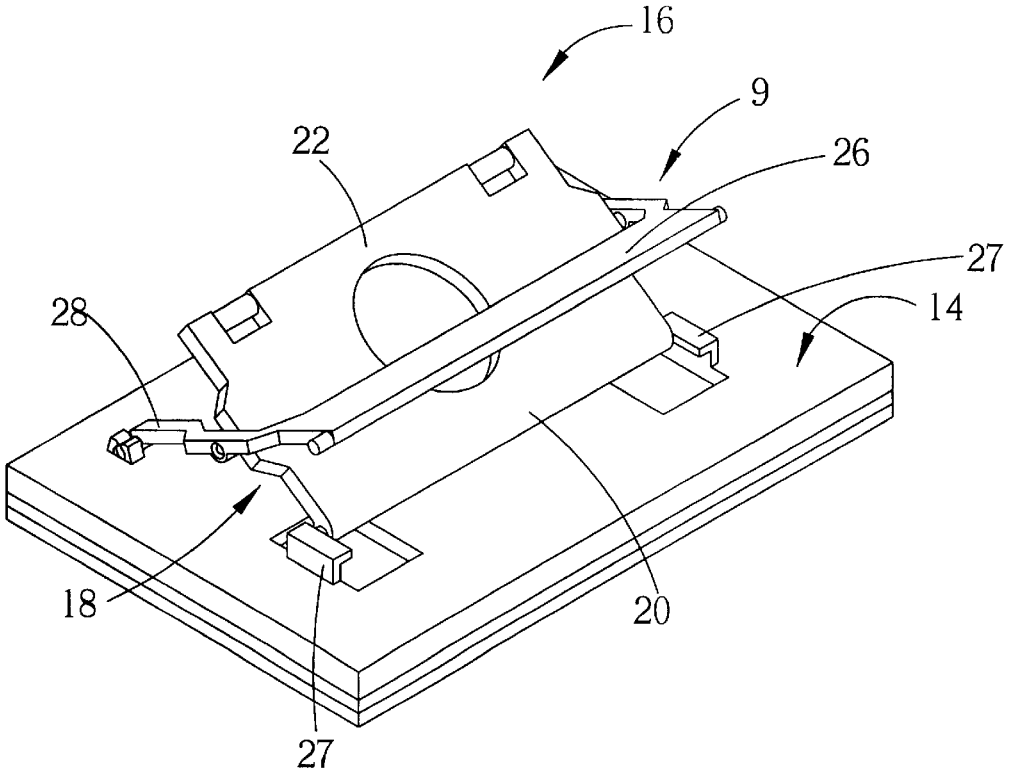
Fig. 4 Prior art
FIG. 4 is a perspective view of the connecting device of the key mechanism shown in FIG. 3.
Figure 5:
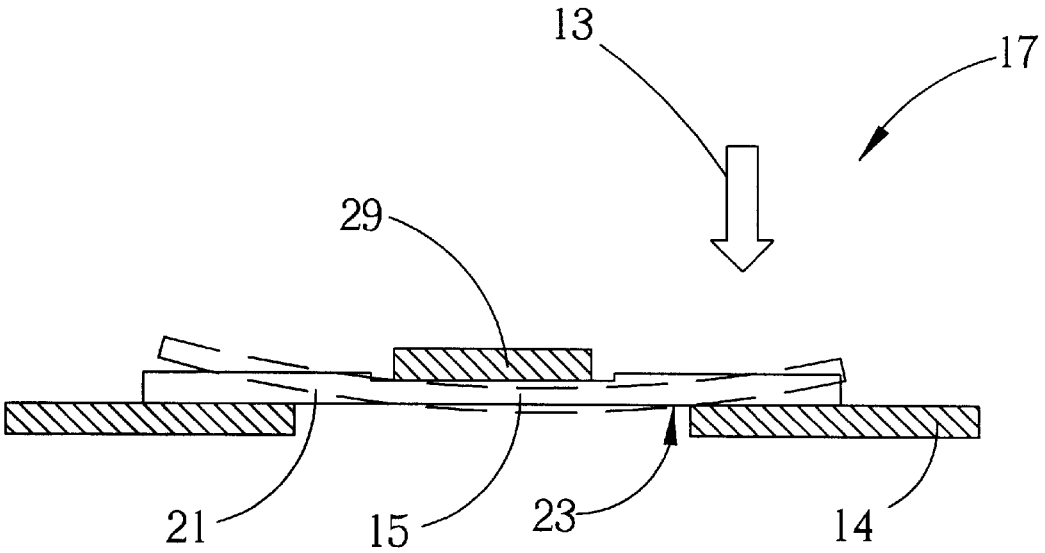
Fig. 5 Prior art
FIG. 5 is a schematic diagram of warping of the front end of the first connecting piece of the connecting device shown in FIG. 2 under loading case II.
Figure 6:
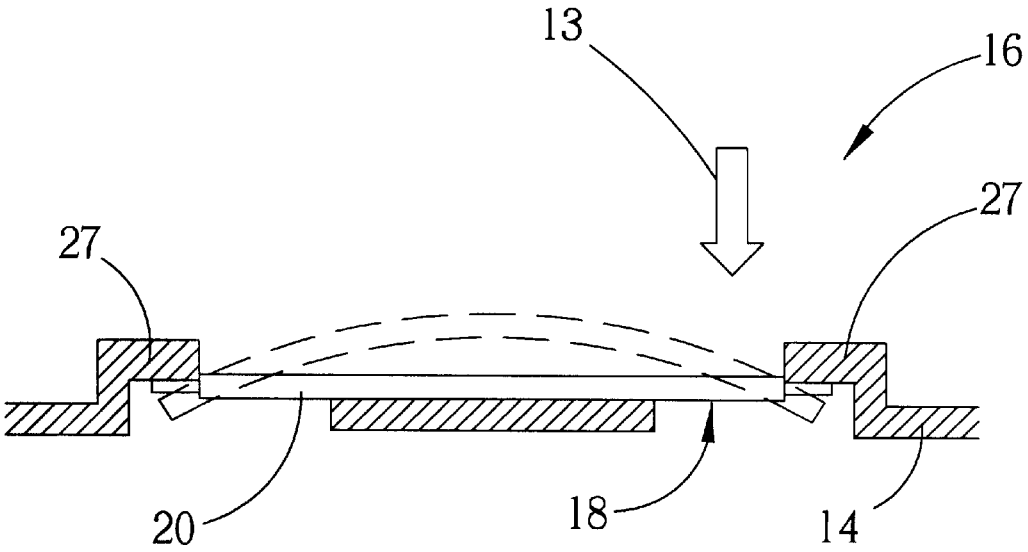
Fig. 6 Prior art
FIG. 6 is a schematic diagram of warping of the front end of the first connecting piece in the connecting device shown in FIG. 4 under loading case II.
Figure 8:
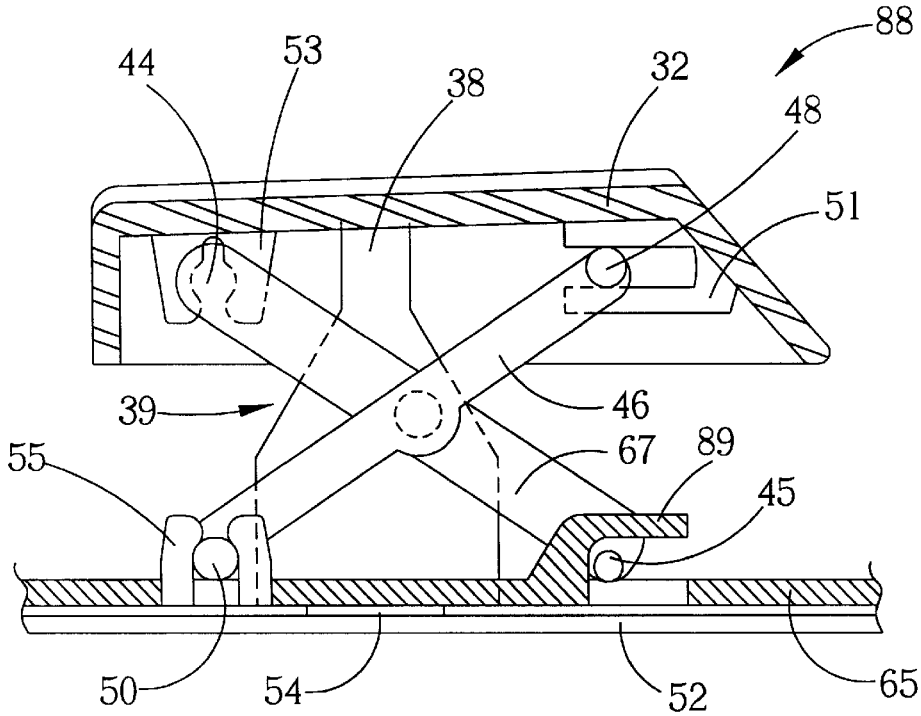
FIG. 8 is a schematic diagram of the key mechanism of the second embodiment of the present invention.
Figure 15:
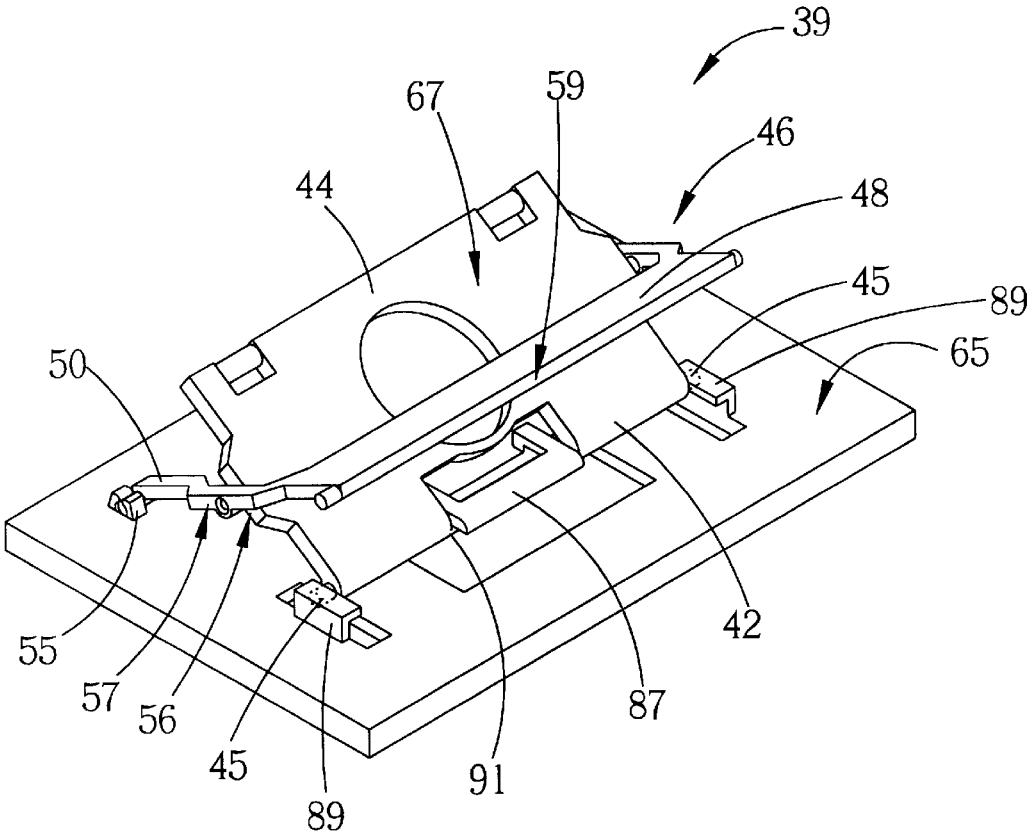
FIG. 15 is a perspective view of the connecting device of the key mechanism as shown in FIG. 8.
Figure 16:
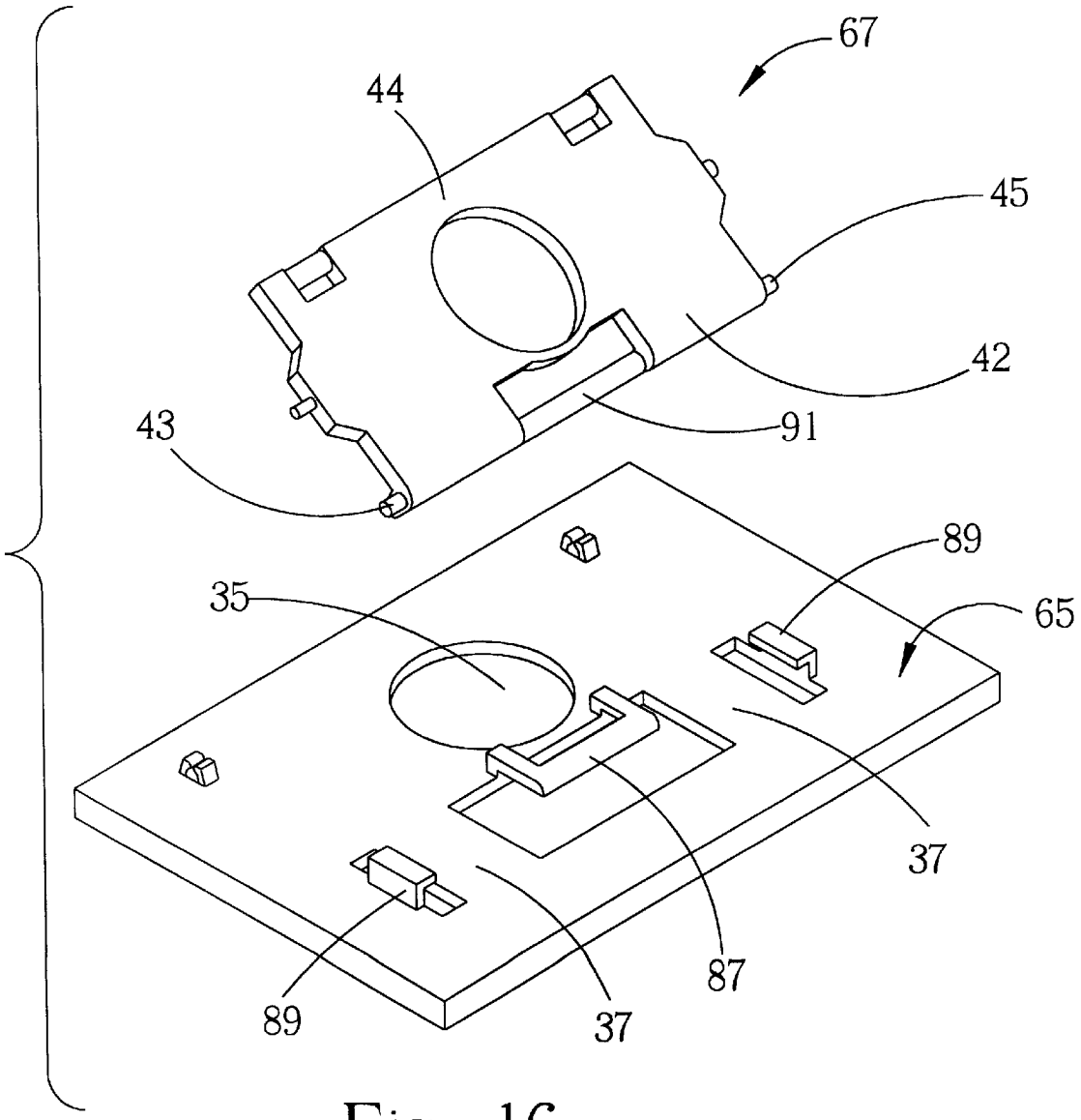
FIG. 16 is an element perspective view of the first connecting piece as well as the guide channel and the limit channel of the base plate as shown in FIG. 15.

The second embodiment of the present invention is a four-point contact like that of the prior art in FIG. 4, but it does not suffer from warping under loading case II. The structure of the second embodiment of the present invention as shown in FIG. 15 and FIG. 16 is similar to that of the first embodiment shown in the perspective view of FIG. 8 and FIG. 10. However, the pair of limit channels 49 of the base plate 34 in the first embodiment are designed as a pair of guide channels 89 of a base plate 65. And what was the guide channel 47 at the central portion of the base plate 34 in the first embodiment is now a limit channel 87 of the base plate 65. Consequently, what were limiting rods 43 of the connecting device 36 are instead designed as a pair of guiding rods 45 at the front end 42 of a first connecting piece 67 of a connecting device 39 as shown in FIG. 15. Similarly, the guiding rod 41 of the first embodiment is designed as a limiting rod 91 of the connecting device 39.

Figure 17:
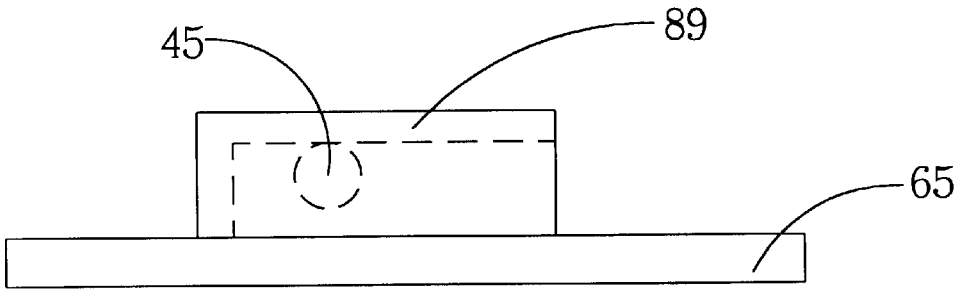
FIG. 17 is a relative position between the limiting rod and the limit channel when the connecting device as shown in FIG. 15 is under loading case I.
Figure 18:
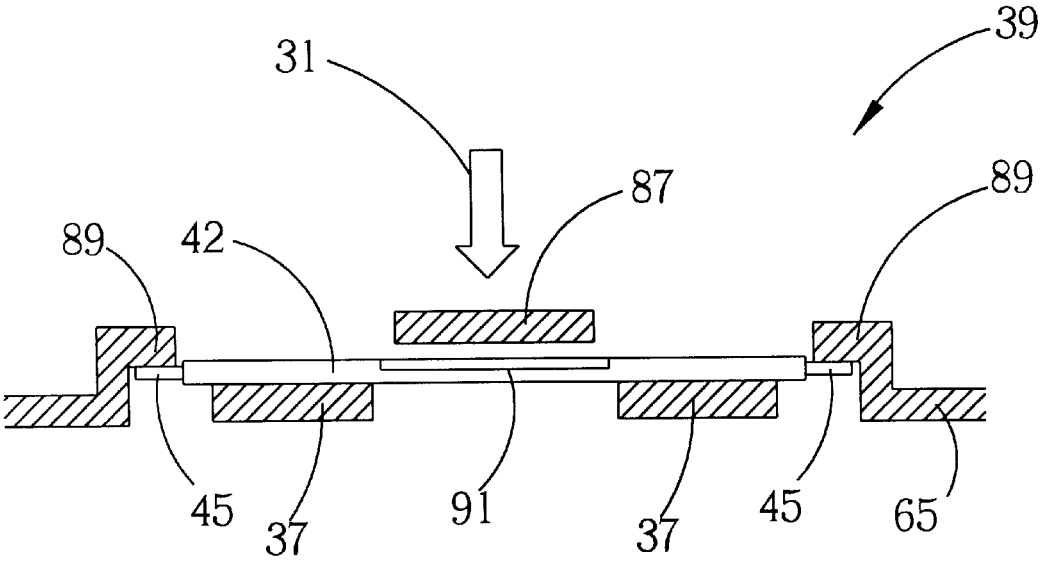
FIG. 18 is a schematic diagram of the first connecting piece of the connecting device as shown in FIG. 15 under loading case I.

Please refer to FIG. 17 and FIG. 18. FIG. 17 is a side view of the relative position between the guide channels 89 of the base plate 65 and the guiding rods 45 of the first connecting piece 67 of the connecting device 39 when the connecting device 39 as shown in FIG. 15 is under loading case I. FIG. 18 is a schematic diagram of the first connecting piece 67 of the connecting device 39 as shown in FIG. 15 under loading case I. As shown in FIG. 17, under loading case I, the design of the second embodiment is such that the guiding rods 45 of the first connecting piece 67 are slidably guided by the guide channels 89 of the base plate 65 by way of contact, but there is no contact between the limit channel 87 of the base plate 65 and the limiting rod 91 of the first connecting piece 67, as shown in FIG. 18. Thus, the connecting device 39 makes use of a four-point connection with the base plate 65. The guiding rods 45 on both the left and right sides of the front end 42 of the first connecting piece 67 are slidably connected to the guide channels 89 of the base plate 65, making the first two contact points. The left and right sides of the rear end 50 of the second connecting piece 46 are pivotally connected to the base plate 65 at the scoop channels 55, making the third and fourth contacts.

When the connecting device 39 is under loading case II, the limit channel 87 on the base plate 65 will limit the warping of the first connecting piece 67 through the limiting rod 91. Therefore, the connecting device 39 is then connected to the base plate 65 by a five-pointconnection, and the first connecting device 67 will slide back and forth on the base plate 35 in a nearly horizontal direction. Thus, the connecting device 67 will ensure vertical pressure on the resilient element 38 by keeping the top surface of it nearly horizontal and without any significant tilt.

Figure 19:
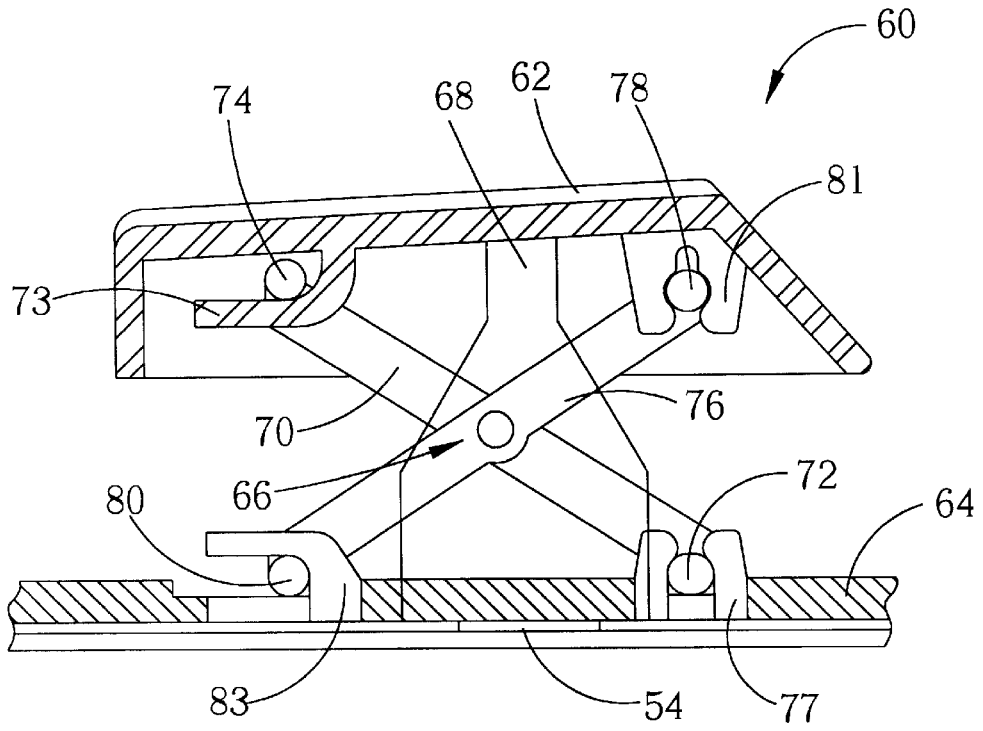
FIG. 19 is a schematic diagram of the key mechanism of the third embodiment of the present invention.
Figure 21:
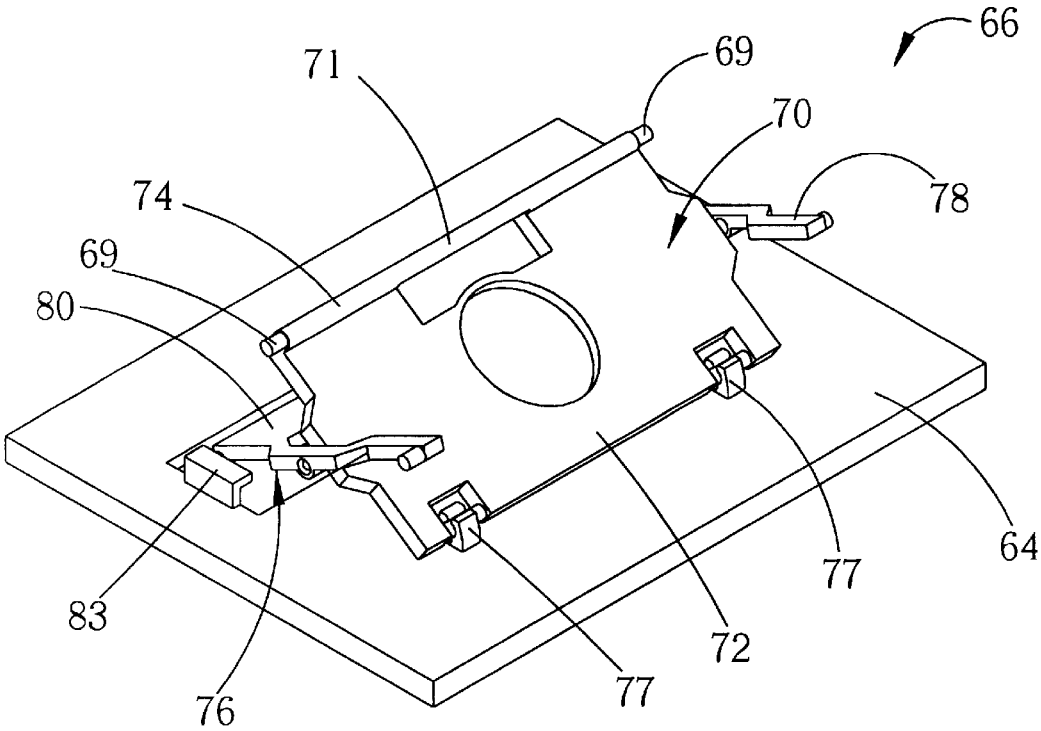
FIG. 21 is a perspective view of the connecting device of the key mechanism as shown in FIG. 19.
Figure 22:
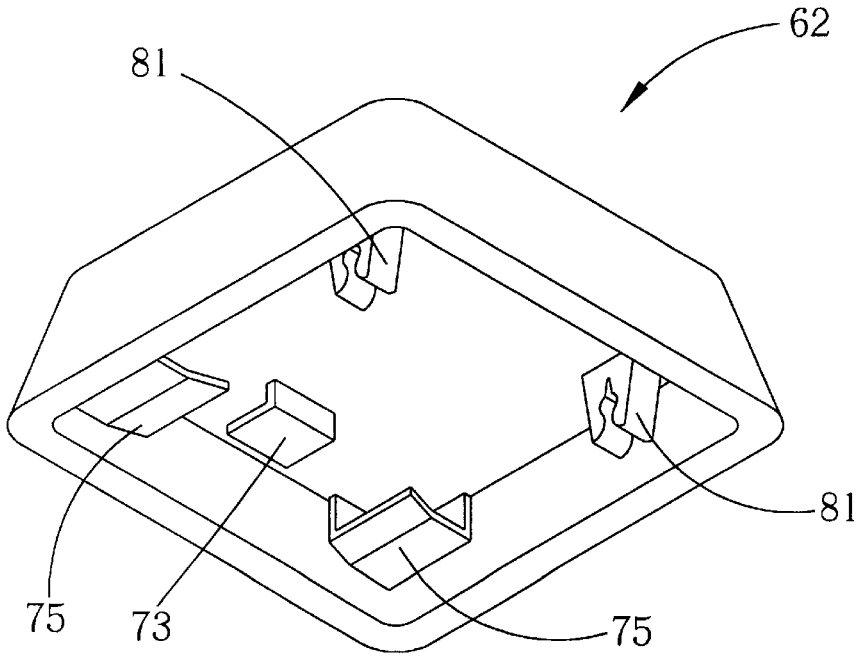
FIG. 22 is a bottom view of the keycap of the key mechanism as shown in FIG. 19.

Please refer to FIG. 19, FIG. 21 and FIG. 22. FIG. 19 is a schematic diagram of the key mechanism 60 of the third embodiment of the present invention. FIG. 21 is a perspective view of the connecting device 66 of the key mechanism 60 as shown in FIG. 19. FIG. 22 is a bottom view of the keycap 62 of the key mechanism 60 as shown in FIG. 19. The third embodiment is designed for improved prevention of warping of the connecting device generated by the keycap under the loading condition II. As shown in FIG. 19 and 21, the key mechanism 60 of the third embodiment of the present invention comprises a keycap 62, a base plate 64, a connecting device 66, and a resilient element 68. The main difference between the key mechanism 60 of the third embodiment of the present invention and the key mechanism 30 of the prior art is the difference in the type of connection of the connecting device to the keycap and to the base plate. The connecting device 66 of the key mechanism 60 of the present invention comprises a first connecting piece 70 and a second connecting piece 76. A pair of limiting rods 69 and a guiding rod 71 are set up on the left and right sides and at the central portion of the rear end 74 of the first connecting piece 70, respectively. The pair of limiting rods 69 and the guiding rod 71 of the rear end 74 of the first connecting piece 70 is slidably connected to and contained in the corresponding pair of limit channels 75 and guide channel 73 in the keycap 62 respectively. The left and right sides of the front end 72 of the connecting piece 70 are pivotally connected to the corresponding scoop channels 77 on the base plate 64. The second connecting piece 76 is a U-type member wherein the left and right sides of its front end 78 are pivotally connected to the pair of corresponding scoop channels 81 on the bottom side of the keycap 62 while the left and right sides of its rear end 80 are slidably connected to and contained in the pair of guide channels 83 on the base plate 64. Moreover, another type of U-type connecting piece (not shown) can also be employed for the second connecting piece 76 of the key mechanism 60 of the present invention wherein the left and right sides of its front end 78 are also pivotally connected to the pair of corresponding scoop channels 81 on the bottom side of the keycap 62 but the central portion (not shown), instead of the left and right sides, of the rear end 80 of the second connecting piece 76 is slidably connected to and contained in a corresponding guide channel (not shown)on the base plate 64.

Please refer to FIG. 23. FIG. 23 is a schematic diagram of the first connecting piece 70 of the connecting device 66 under loading case I. As shown in FIG. 23, under loading case I, the guiding rod 71 at the rear end 74 of the first connecting piece 70 is slidably connected to and guided by the guide channel 73 on the bottom side of the keycap 62 by way of contact, but there are no contacts between the pair of limiting rods 69 at the rear end 74 of the first connecting piece 70 and the pair of limit channels 75 on the bottom side of the keycap 62. The first connecting piece 70 is slidably connected to the keycap 62 by the guiding rod 71, while the second connecting piece 76 is pivotally connected to the keycap 64 by its left and right sides of the front end 78 to the corresponding scoop channels 81 on the bottom side of the keycap 62. Thus, a three-point contact is employed for the connection between the connecting device 66 and the keycap 62.

Please refer to FIG. 24. FIG. 24 is a schematic diagram of the first connecting piece 70 of the connecting device 66 as shown in FIG. 19 under loading case II. The pair of limit channels 75 of the keycap 62 will limit the warping of the first connecting piece 70, ensuring that it slides back and forth in a nearly horizontal manner. In this case, in addition to the foregoing contact point between the guided rod 71 and the guide channel 73, two more contact points are added between the pair of limiting rods 69 and the pair of limit channels 75. This then constitutes a five-point connection between the connecting device 66 and the keycap 62 under loading case II instead of the three-point connection under loading case I as described previously.

Figure 20:
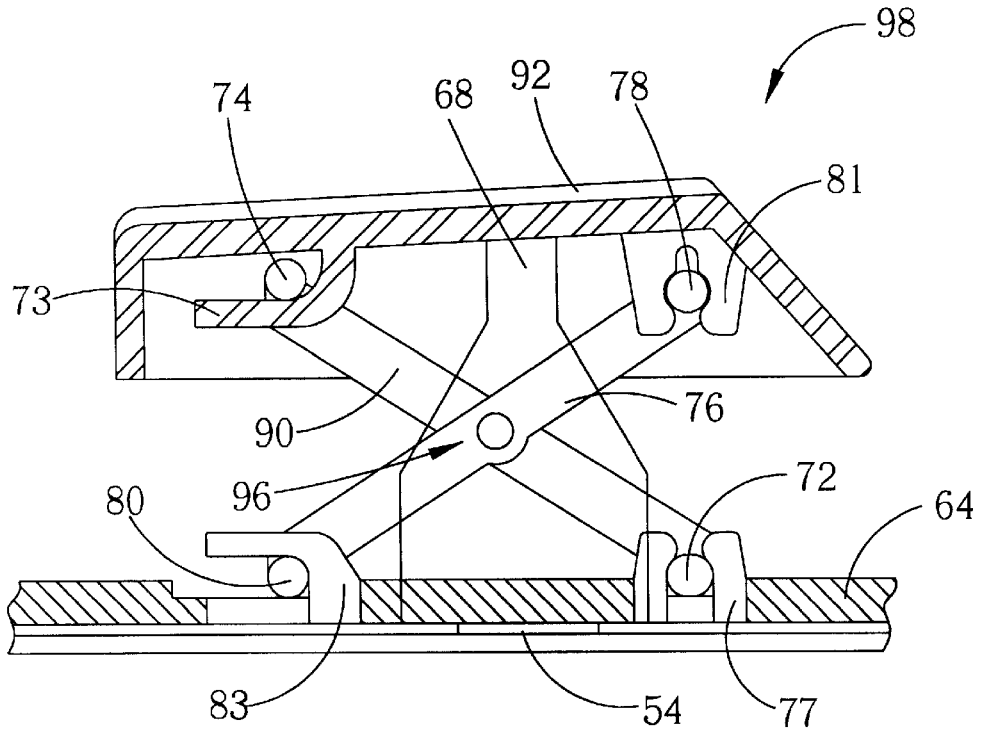
FIG. 20 is a schematic diagram of the key mechanism of the fourth embodiment of the present invention.
Figure 25:
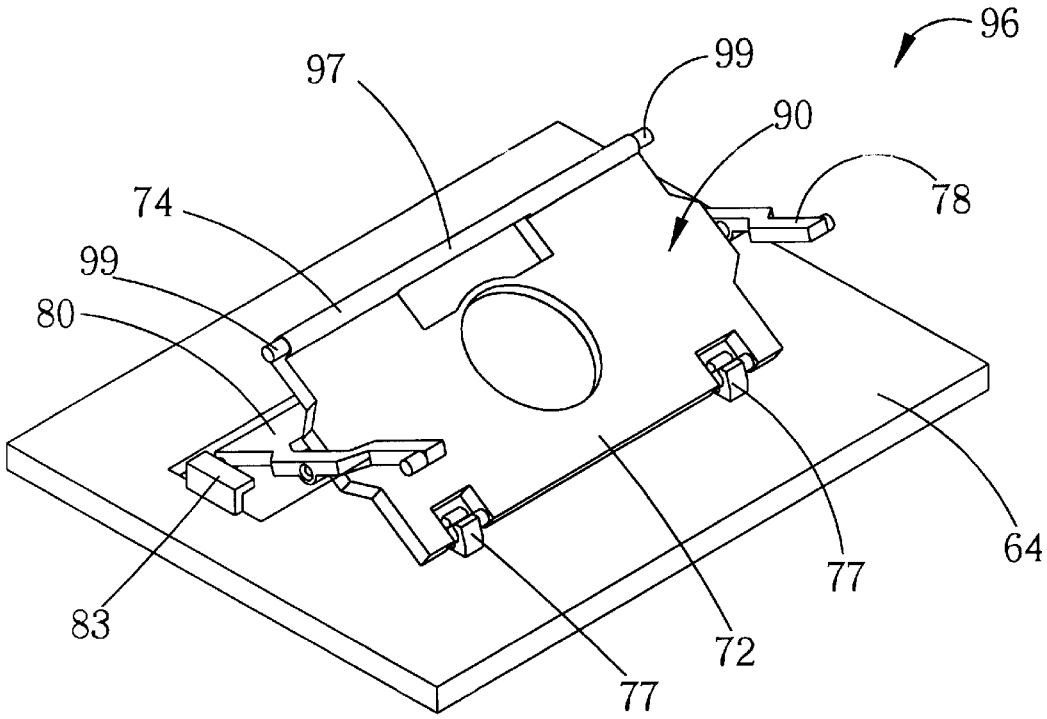
FIG. 25 is a perspective view of the connecting device of the key mechanism as shown in FIG. 20.
Figure 26:
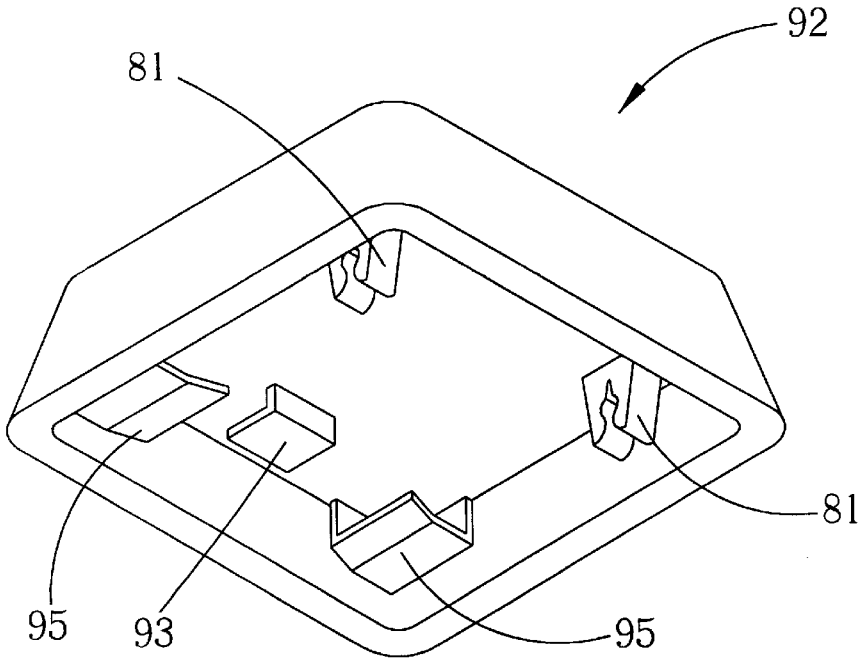
FIG. 26 is a bottom view of the keycap of the key mechanism as shown in FIG. 20.

A fourth embodiment of the present invention as shown in FIG. 20, FIG. 25 and FIG. 26 utilizes a four-point connection at a keycap 92 instead of the three-point connection used at the keycap 62 in the third embodiment of the present invention as shown in FIG. 19, FIG. 21 and FIG. 22. The structure of the fourth embodiment is similar to that of the third embodiment except that, functionally, the pair of limit channels 75 of the keycap 62 are re-designed as a pair of guide channels 95 of the keycap 92 while the guide channel 73 on the bottom side of the keycap 62 is re-designed as a limit channel 93 of the keycap 92. Moreover, the pair of limiting rods 69 are instead designed as a pair of guiding rods 99 of a first connecting piece 90 of a connecting device 96 while the guiding rod 71 at the central portion of the first connecting piece 70 is re-designed as a limiting rod 97 of the first connecting piece 90 of the connecting device 96.

Figure 27:
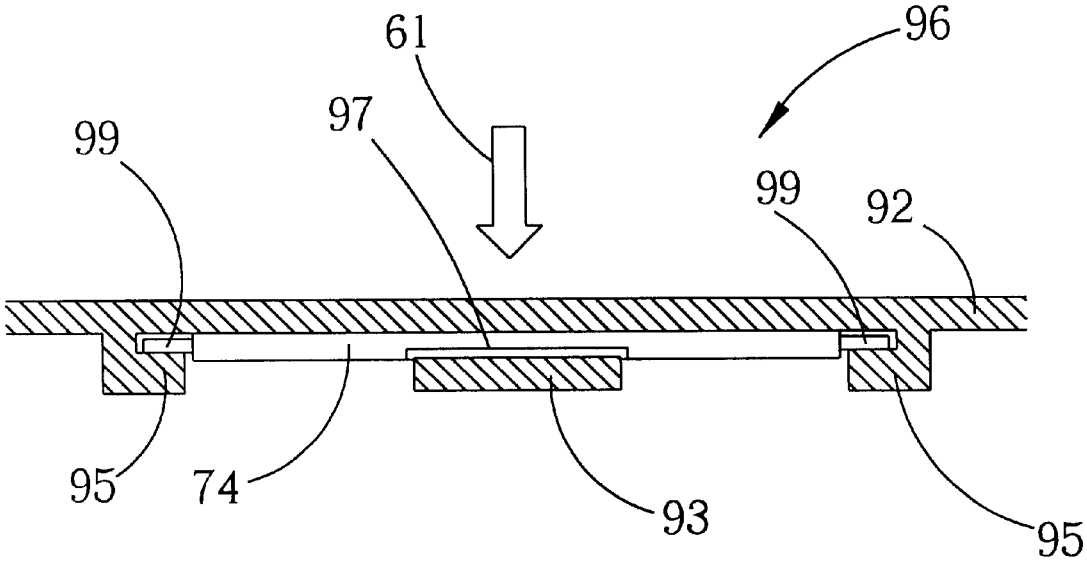
FIG. 27 is a schematic diagram of the first connecting piece of the connecting device as shown in FIG. 20 under loading case I.

Please refer to FIG. 27. FIG. 27 is a schematic diagram of the first connecting piece 90 of the connecting device 96 of the fourth embodiment as shown in FIG. 25 and FIG. 26 of the present invention under loading case I wherein the arrow head 61 represents the applied balanced force. As shown in FIG. 27, under loading I, the pair of guiding rods 99 of the first connecting piece 90 contact the pair of guide channels 95 of the keycap 92. The first connecting piece 90, through its pair of guiding rods 99 on the left and right sides of the rear end 74 of the first connecting piece 90, is slidably connected to and contained in the corresponding pair of guide channels 95 on the bottom side of the keycap 92 while the second connecting piece 76, through the left and right sides of the front end 78, is pivotally connected to the corresponding pair of scoop channels 81 on the bottom side of the keycap 92. So, the connecting device 96 under loading case I uses a four-point contact.

Under loading case II, the limit channel 93 of the keycap 92 will limit the warping of the first connecting piece 90 through contact of the limiting rod 97, ensuring nearly horizontal movement of the first connecting piece 90. In this case, in addition to the foregoing contact points between the guided rods 99 and the guide channels 95, another contact point is added between the limited rod 97 and the limit channel 93. Thus, the type of connection between the connecting device 96 and the keycap 92 is a five-point contact under loading case II instead of a four-point contact under loading case I as described previously.

In comparison with the connecting device 16, 17 of the key mechanism 10, 11 of the prior art, the first connecting piece 40, 67 of the connecting device 36, 39 of the key mechanism 30, 88 is back-and-forth movably connected to and contained in the guided channels 47,89 of the base plate 34, 65 respectively by the use of the guiding rods 41, 45 of the front end 42 of the first connecting pieces 40, 67. Moreover, the first connecting pieces 70, 90 of the connecting device 66, 96 of the key mechanism 60, 98 are back-and-forth movably connected to and contained in the guided channels 73, 93, 75, 95 on the bottom side of the keycap 62, 92 respectively by the use of the guiding rods 71, 97 of the rear end 74 of the first connecting piece 70, 90. Therefore, the first connecting pieces 40, 67, 70, 90 can slide back-and-forth in an approximately horizontal direction. What is more, when the key mechanism is subjected to an applied force and undergoes warping, the connecting devices 36, 39, 66, 96 will provide relatively better anti-warping strength due to the five-point contact between the limiting rods 43, 69, 91, 97 and the limit channels 49, 75, 87, 93. Even if the key mechanism is subjected to an unbalanced force of loading case II, the connecting device 36, 39, 66, 96 continues to supply vertical pressure on the resilient elements 38, 68 along an approximately horizontal plane to ensure that the pressure sensor 54 installed beneath the resilient element 38, 68 generates a stable key-press signal.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A key mechanism used in a computer keyboard comprising:

a keycap;

a base plate installed under the keycap having three guide channels; and a connecting device installed between the keycap and the base plate for movably connecting the keycap to the base plate in an up and down manner, the connecting device further including:

a first connecting piece having a front end, a center portion, and a rear end, and a second connecting piece having a front end, a center portion, and a rear end, each of the center portions of the first and second connecting pieces having a left end and a right end, and the left and right ends of the center portion of the first connecting piece being pivotally connected to the left and right ends of the center portion of the second connecting piece;

wherein a left end, a right end and a center portion of the front end of the first connecting piece are slidably and separately received in the three guide channels while the rear end of the first connecting piece is pivotally mounted beneath the keycap, and the front end and the rear end of the second connecting piece are slidably or pivotally mounted to the keycap or the base plate respectively.

2. The key mechanism of claim 1 wherein the front end of the first connecting piece comprises a central rod installed at its center portion and two side rods installed at its left and right ends respectively, and the three guide channels of the base plate comprise a central guide channel for receiving the central rod and a pair of side guide channels for receiving the two side rods respectively, wherein when the first connecting piece is actuated, the central guide channel will guide the central rod to slide forward or backward, and when the first connecting piece is unbalancedly actuated, the two side guide channels will restrict the two side rods of the first connecting piece from moving upward or downward and force the two side rods of the first connecting piece to horizontally slide forward or backward.

3. The key mechanism of claim 1 wherein the front end of the first connecting piece comprises a central rod installed at its center portion and two side rods installed at its left and right ends respectively, and the three guide channels of the base plate comprise a central guide channel for receiving the central rod and a pair of side guide channels for receiving the two side rods respectively, wherein when the first connecting piece is actuated, the two side channels will guide the two side rods to slide forward or backward, and when the first connecting piece is unbalancedly actuated, the central channel will restrict the central rod of the first connecting piece from moving upward or downward and force the central rod to slide forward or backward.

4. The key mechanism of claim 1 further comprising a resilient element installed under the keycap for elastically supporting the keycap upwardly.

5. The key mechanism of claim 4 further comprising a base stand mounted under the base plate wherein a penetration hole is set up on the base plate and the lower portion of the resilient element is penetrated through the penetration hole and seated on the base stand while the upper portion of the resilient element touches the lower end of the keycap for sustaining the keycap upwardly.

6. The key mechanism of claim 5 further comprising a pressure sensor set up between the base stand and the resilient element wherein when the keycap is pressed downward, the resilient element will be pushed downward to depress the pressure sensor so as to generate a key signal.

7. The key mechanism of claim 1 wherein the second connecting piece is in a U-shape having one front end and two rear ends, and the front end of the second connecting piece is slidably connected to a pair of guide channels installed at a lower end of the keycap while the two rear ends of the second connecting piece are pivotally connected to the base plate.

8. A key mechanism used in a computer keyboard comprising:

a keycap having three guide channels on its lower end;

a base plate installed under the keycap; and a connecting device installed between the keycap and the base plate for movably connecting the keycap to the base plate in an up and down manner, the connecting device including:

a first connecting piece having a front end, a rear end, and a center portion, and a second connecting piece having a front end, a rear end, and a center portion, each of the center portions of the first and second connecting pieces having a left end and a right end and the left and right ends of the center portion of the first connecting piece being pivotally connected to the left and right ends of the center portion of the second connecting piece;

wherein a left end, a right end and a center portion of the rear end of the first connecting piece are slidably received in the three guide channels on the lower end of the keycap while the front end of the first connecting piece is pivotally mounted to the base plate, and the front and rear ends of the second connecting piece are pivotally or slidably mounted to the keycap or the base plate respectively.

9. The key mechanism of claim 8 wherein the rear end of the first connecting piece comprises a central rod installed at its center portion and two side rods installed at its left and right ends respectively, and the three guide channels at the lower end of the keycap comprises a central guide channel for receiving the central guided rod and a pair of side guide channels for receiving the two side rods respectively, wherein when the first connecting piece is actuated, the central guide channel will guide the central rod to slide forward and backward, and when the first connecting piece is unbalancedly actuated, the two guide channels will restrict the two side rods of the first connecting piece from moving upward or downward and force the two side rods of the first connecting piece to horizontally slide forward and backward.

10. The key mechanism of claim 8 wherein the rear end of the first connecting piece comprises a central rod installed at its center portion and two side rods installed at its left and right ends respectively, and the three guide channels at the lower end of the keycap comprises a central guide channel for receiving the central rod and a pair of side guide channels for receiving the two side rods respectively, wherein when the first connecting piece is actuated, the two side guide channels will guide the two side rods to slide forward or backward, and when the first connecting piece is unbalancedly actuated, the central guide channel will restrict the central rod of the first connecting piece from moving upward or downward and force the central rod to slide forward or backward.

11. The key mechanism of claim 8 further comprising a resilient element installed under the keycap for elastically supporting the keycap upwardly.

12. The key mechanism of claim 11 further comprising a base stand mounted under the base plate wherein a penetration hole is set up on the base plate and the lower portion of the resilient element is penetrated through the penetration hole and seated on the base stand while the upper portion of the resilient element touches the lower end of the keycap for sustaining the keycap upwardly.

13. The key mechanism of claim 12 further comprising a pressure sensor set up between the base stand and the resilient element wherein when the keycap is pressed downward, the resilient element will be pushed downward to depress the pressure sensor so as to generate a key signal.

14. The key mechanism of claim 8 wherein the second connecting piece is in a U-shape having two front ends and one rear end, and the rear end of the second connecting piece is slidably connected to a pair of guide channels installed on the base plate while the two front ends of the second connecting piece is pivotally connected to the keycap.

* * * * *